United States Patent [19]

Tezanos

[11] Patent Number: 4,776,941

[45] Date of Patent: Oct. 11, 1988

[54] CATHODE FOR METAL ELECTROWINNING

[76] Inventor: Enrique H. Tezanos, Aniceto Marinas 110, 28008 Madrid, Spain

[21] Appl. No.: 875,630

[22] Filed: Jun. 18, 1986

[30] Foreign Application Priority Data

Jun. 21, 1985 [ES] Spain ..... 544444

[51] Int. Cl.[4] ..... C25B 9/00; C25C 7/00; C25D 17/12

[52] U.S. Cl. ..... 204/259; 204/263; 204/275; 204/284; 204/290 R

[58] Field of Search ..... 204/107, 280, 281, 283, 204/284, 257, 259, 268, 269, 290 R, 106, 287, 275, 263, 242; 204/64 R, 64 T, 45.1, 45.5, 52 R

[56] References Cited

U.S. PATENT DOCUMENTS

| | | | |
|---|---|---|---|
| 843,616 | 7/1906 | Leitch | 204/287 |
| 2,908,619 | 10/1959 | Barnett | 204/284 |
| 3,082,159 | 3/1963 | Reimert | 204/64 T |
| 3,915,834 | 10/1975 | Wright et al. | 204/284 |
| 4,392,924 | 7/1983 | Armand | 204/64 T |
| 4,588,485 | 5/1986 | Cohen et al. | 204/64 T |
| 4,645,578 | 2/1987 | Suarez-Infanzon | 204/107 |

*Primary Examiner*—John F. Niebling
*Assistant Examiner*—Ben C. Hsing
*Attorney, Agent, or Firm*—Wolf, Greenfield & Sacks

[57] ABSTRACT

A cathode for metal electrowinning is a hollow electrode, with orifices in the cathodic plates, formed in such a way that the catholyte, introduced with the necessary pressure in the interior of the cathode, goes to the interelectrodic space through those orifices, and is subjected there to the existing electrical field, taking place then the electrodeposition of the cations on the external surface of the cathodic plates.

5 Claims, 2 Drawing Sheets

CATHODE FOR METAL ELECTROWINNING

BACKGROUND OF THE INVENTION

The production of metals through its electrodeposition in the cathode of an electrolysis cell is an technique with practically a century of industrial history.

The metals are produced via electrolysis of either dissolved or molten salts, depending on their chemical peculiarities. The cations move from the electrolyte toward the cathode surface, where they are reduced into elemental metals, discharged there and removed, continuously or discontinuously, from there.

When molten salt is used as the anolyte, the deposited metal is usually recovered in liquid state, and it is poured molten from the cell. This is the case for aluminum and magnesium electrowinning.

There is an ample range of other metals, however, that are electrowon from liquid solutions, mainly aqueous ones, and discharged as solid metals. The morphology of this solid can be as compact as plates, or any variety of spongy, porous deposits.

The invention that is the subject of this patent deals with the electrowinning of solid metals from solutions, whatever their form. It could be applied to mercury electrowinning as well, but obviously it is an exception.

The design of an industrial electrowinning cell requires solving a number of engineering problems. The main one is the conflict between the conflicting requirements imposed by two aspects of the operation:

The need for minimizing investment costs demands that cathode surface be as wide as possible. On the other hand, the need for minimizing operating costs demands that the anode-cathode distance be as small as possible, in order to avoid useless energy costs derived from the ohmic resistance in that space.

When engineers try to satisfy both demands, the result will be a wide cathodic surface (in the order of 1 $m^2$/unit) separated from the corresponding anodic surface, or any separating surface between anode and cathode by merely 20–30 mm gap.

However, this solution poses a strong constraint for the electrolyte access to the whole cathodic surface. The required feed to every spot of the surface is made from some peripheral point, and it is hindered by the small cross-section available for the flow. The electrolyte must be present with constant composition in the vicinity of the whole electrodic surface. When flow restrictions cause local concentration depletion, the electrochemical conditions are changed, and the results may be degraded, ranging from loss of current efficiency to change in the deposit composition.

Techniques to overcome such conflict have been developed over the years, as common practice in electrowinning installations and patented inventions. Among the more common procedures, it is worthwhile to cite the high rate of catholyte recirculation, or nozzle injection in the interelectrodic space, or gas bubbling there; all of them aiming for a greater turbulence degree, in such a way that mass transport is enhanced.

This problem is a typically cathodic one, usually not applicable to the anodes, as gas is usually produced at the anode, and its bubbling produces enough turbulence to overcome this problem. But similar considerations could be raised when anodic product is not a gas.

The problem described above is important even when smooth, regular flat metal deposits are formed on the cathodic surface. But the disadvantage is greater in cases where the metal deposits grow in porous, spongy, or highly dentritic forms. The irregularities of the surface increase progressively the resistance to the electrolyte flow, up to points of damage, due to extensive restriction and large local concentration depletion.

SUMMARY OF THE INVENTION

The object of this invention is a new cathode design, that overcomes this problem through a new method for feeding the catholyte.

The invention comprises the use of a hollow metallic structure for the cathode. The hollow piece is formed by two parallel plates, each with the chosen surface to be used as electrodic surface. Both plates are united in the borders, to each other, in such a way that a minimum distance of 5–10 mm separates them. The key to the invention is to feed the catholyte into the space between the plates. From there, it comes out to the outside surface through tiny orifices regularily bored in the whole surface. In this way the flow restrictions posed by the deposit are constrained to the small area served by each orifice. Consequently, its negative effect is dramatically reduced, as with small, reduced size cathodes.

This invention practically eliminates the need of turbulence enhancing techniques. The optimum distribution of holes will vary with each electrochemical system, and consequently must be tailored for each practical problem. Any turbulence enhancing techniques additionally available may be used at will, obviously; but the best results may be obtained by approaching the orifices as close as required.

BRIEF DESCRIPTION OF THE DRAWINGS

For a better understanding of the present invention together with other and further objects, advantages and capabilities thereof, reference is made to the accompanying drawings in which.

DETAILED DESCRIPTION OF THE INVENTION

Figure 1:
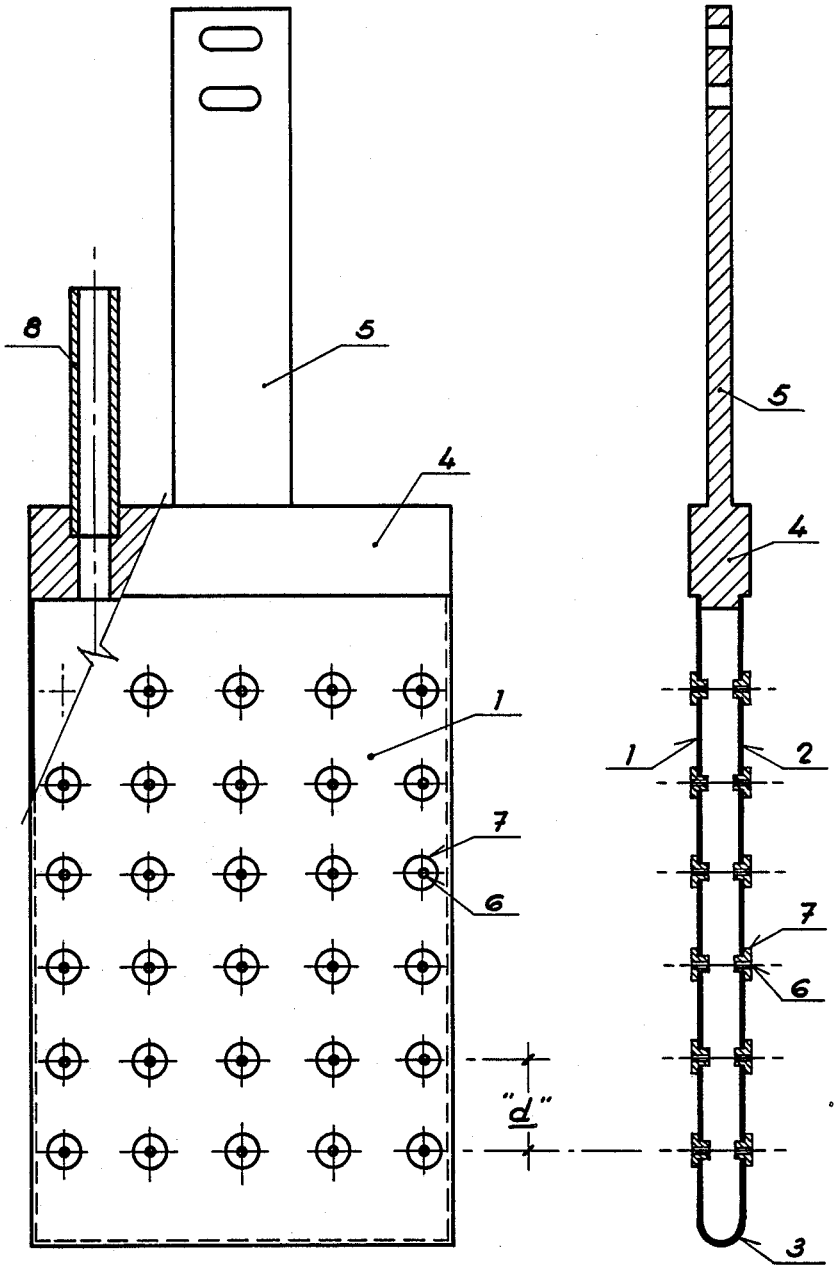
FIG. 1 is an elevation view, partly in cross-section, of the cathode of the present invention.

The idea is represented in FIG. 1, where the cathode is shown schematically in front and side views. The plates, 1 and 2, are formed, in this solution, by a continuous sheet bent at in the bottom 3, and welded at the top to a massive piece of metal, 4, including a mounting strip 5, acting as electrical manifold to which the electrical connection is welded.

A number of tiny orificies (0.5–2 mm diameter, typically), 6, have been regularly bored in the cathodic surface, at a distance, d, adequate for each system. A typical value, by no means exclusive, is 30 mm.

The tiny orifices could be directly bored in the metals plate, but a more practical solution is to have a plastic, or other non-conductive material, button, 7, fixed in regularly placed holes, in the cathodic surface, and the orifices being bored in these buttons. With this particular way of carrying the invention into practice, that must not had considered either exclusive or the optimum, two advantages are obtained: the tiny orifices are bored in a softer material, with the inherent reduction in manufacturing costs, and a non conductive area is established around the orifice, thus avoiding the possibility that any electrodeposited metal could block it.

The catholyte is introduced into the inner cavity of the electrode through the tube 8. From there, it goes out to the interelectrodic space through the orifices.

The lateral sides of the cathode can be closed by any chosen mechanical arrangement, since it is not essential to the invention. We do not detail here any of the multiple possibilities for this construction aspect, because it is not relevant to the invention.

Figure 2:
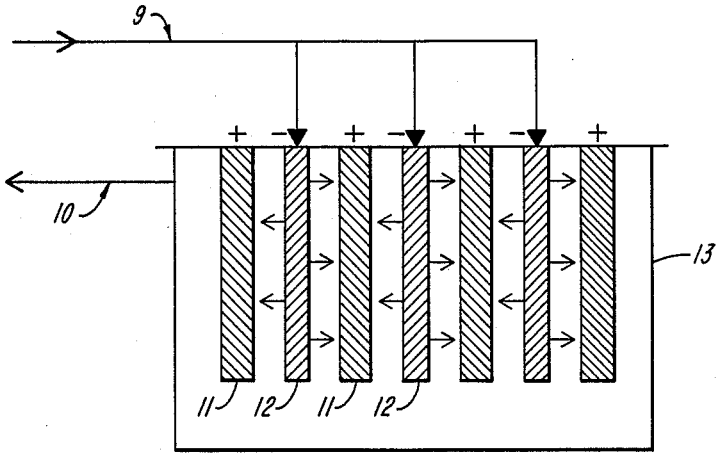
FIG. 2 is a simplified cross-sectional view of an electrowinning cell that uses the cathode of FIG. 1.

FIG. 2 is a schematic representation of an electrolytic cell utilizing the cathode of the present invention. The electrolytic cell includes a housing 13, anodes 11 and cathodes 12. The cathodes 12 are constructed in accordance with the present invention. The electrolyte is supplied to cathodes 12 through lines 9 and is exhausted from the cell through line 10.

This invention has been described as applicable mainly to the negative electrode of an electrolysis cell (cathode), because this is the case where more usefullnes is immediately achievable. But it could be applied also to the positive electrode, anode, whenever the mass transport phenomenon could become a problem.

As illustration of the performance improvement with the use of this invention, we described the following:

EXAMPLE NO. 1

A metal electrowinning cell, in the way described in U.S. Pat. No. 4,645,578, was used for winning copper and chlorine from a cupric chloride solution. Both electrodes were separated, in the way described in the above mentioned patent, by a Nafion membrane. The cathode plates had surface dimensions of 35×20 cm in each electrodic face. Two different types of cathodes were used: one of them a titanium plate, in the conventional flat, smooth and regular surface, the second one with the same titanium material, in the way described in this invention, with orifices of 1 mm diameter bored into teflon buttons of 6 mm diameter each. The distance between center lines of adjacent orifices was 30 mm.

The catholyte composition was maintained constant: Cu: 10 g/L, HCl: 10 g/L, NaCl: 250 g/L, Fe: 20 ppm, Pb: 27 ppm, Zn: 11 ppm.

The anolyte composition was a 250 g/L brine, as usual with this type of cells. A cathodic current density of 1500 A/m$^2$ was used. There was no significant cell voltage difference for each case.

The different results obtained with both types of cathodes were:

| | Conventional plate cathode | Hollow Cathode (according to this invention) |
|---|---|---|
| Cathodic current efficiency | 88,6 | 94,0 |
| Impurities in the copper metal ppm | | |
| Fe | 6 | 1 |
| Pb | 60 | 5 |
| Zn | — | 8 |

Clear improvements are shown in current efficiency as well as in product quality.

EXAMPLE NO. 2

The same cell was used for electrolysis of a lead chloride solution into lead and chlorine. A catholyte with 10 g/L of Pb, 10 g/L of HCl and 250 g NaCl/L was used, with a cathodic current density of 1500 A/m$^2$. Lead is discharged as polycrystalline sponge in both types of cathodes, but current efficiency was 68% in the conventional cathode, while 94.5% was achieved using the hollow cathode according to this invention. A clear improvement in energy consumption is demonstrated.

We claim:

1. An electrowinning cell for metal electrowinning comprising an anode and a cathode, said cell having an electrical field in an interelectrodic space between the cathode and the anode, said cathode comprising a hollow electrode defining an interior and including conductive metallic cathodic plates with orifices in the cathodic plates, said anode being positioned external to the hollow interior of said cathode, and means for introducing an electrolyte with the necessary pressure into the interior of the cathode, so that the electrolyte goes to the interelectrodic space through the orifices, and is subjected there to the existing electrical field, electrodeposition of cations to form a metal deposit on the external surface of the cathodic plates then taking place, said orifices being formed in insulating inserts in the conductive metallic plates, in order to avoid metal deposition around the orifices.

2. A cathode according to claim no. 1, where the distance between orifices in the cathodic plates is reduced in order to increase the uniformity of the metal deposit on the cathodic plates.

3. A cathode according to claim no. 1, or 2, where the cathodic surface is cylindrical or undulating.

4. An electrowinning cell for metal electrowinning comprising a cathode and a closely-spaced anode separated by an interelectrode space, the cathode comprising an electrode defining a hollow interior and including a surface with a plurality of orifices communicating with the interior, said surface of said cathode including insulating inserts having said orifices formed therein, said anode being positioned external to the hollow interior of said cathode, and means for introducing an electrolyte with the necessary pressure into the interior so that the electrolyte passes through said orifices into the interelectrode space.

5. A cathode as defined in claim 4 wherein said electrode comprises parallel conductive metallic plates.

* * * * *